United States Patent [19]

Halford et al.

[11] Patent Number: 4,485,586

[45] Date of Patent: Dec. 4, 1984

[54] SHIFTING MECHANISM FOR TOY VEHICLE

[75] Inventors: Wayne R. Halford, Manhattan Beach; William J. Kelley, Torrance, both of Calif.

[73] Assignee: Mattel, Inc., Hawthorne, Calif.

[21] Appl. No.: 345,297

[22] Filed: Feb. 3, 1982

[51] Int. Cl.[3] ..... A63H 17/00

[52] U.S. Cl. ..... 446/448; 446/463

[58] Field of Search ..... 46/206, 209, 213, 201, 46/202, 211, 208, 252

[56] References Cited

U.S. PATENT DOCUMENTS

| | | | |
|---|---|---|---|
| 2,070,465 | 2/1937 | Carl | 46/213 |
| 2,560,739 | 7/1951 | Perez | 46/213 X |
| 2,775,848 | 1/1957 | Isaacson | 46/252 |
| 4,272,914 | 6/1981 | Orenstein | 46/209 |

FOREIGN PATENT DOCUMENTS

| | | | |
|---|---|---|---|
| 857033 | 12/1970 | Canada | 46/206 |

*Primary Examiner*—Mickey Yu

*Attorney, Agent, or Firm*—John G. Mesaros; Ronald M. Goldman; Max E. Shirk

[57] ABSTRACT

A toy vehicle having a motor drive mechanism with a control arm actuable from a first position to a second position for changing the speed thereof, the vehicle having a pivotable linkage arm with a cam follower coacting with a cam movable in response to vehicle travel for pivoting a trigger foot against the control arm for moving it from the first position to the second position.

11 Claims, 8 Drawing Figures

Fig. 1.
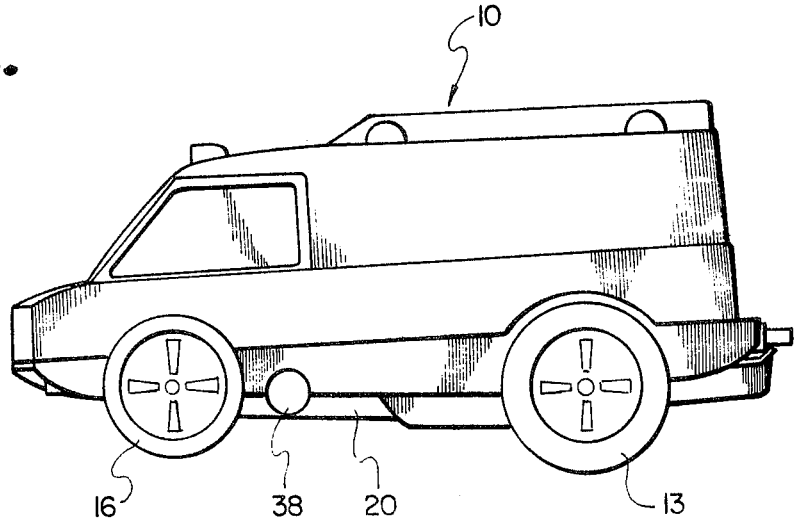
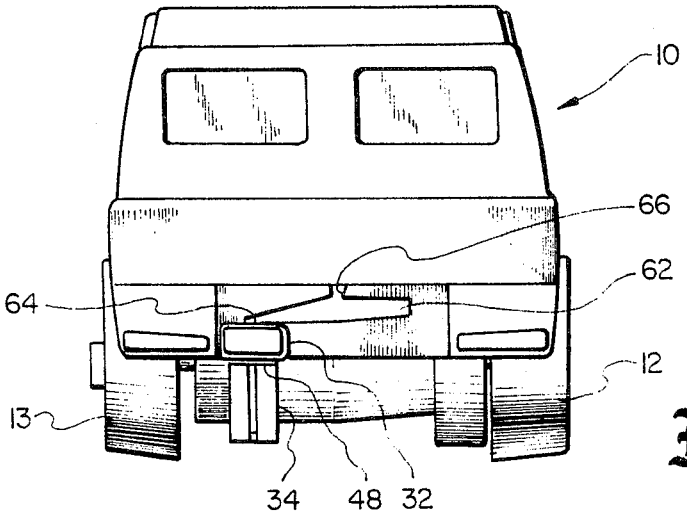
Fig. 2.
Fig. 3.
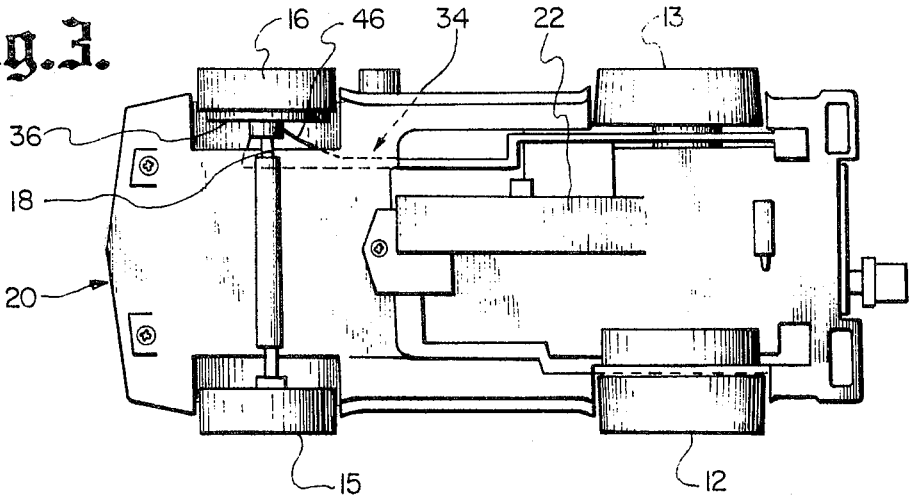

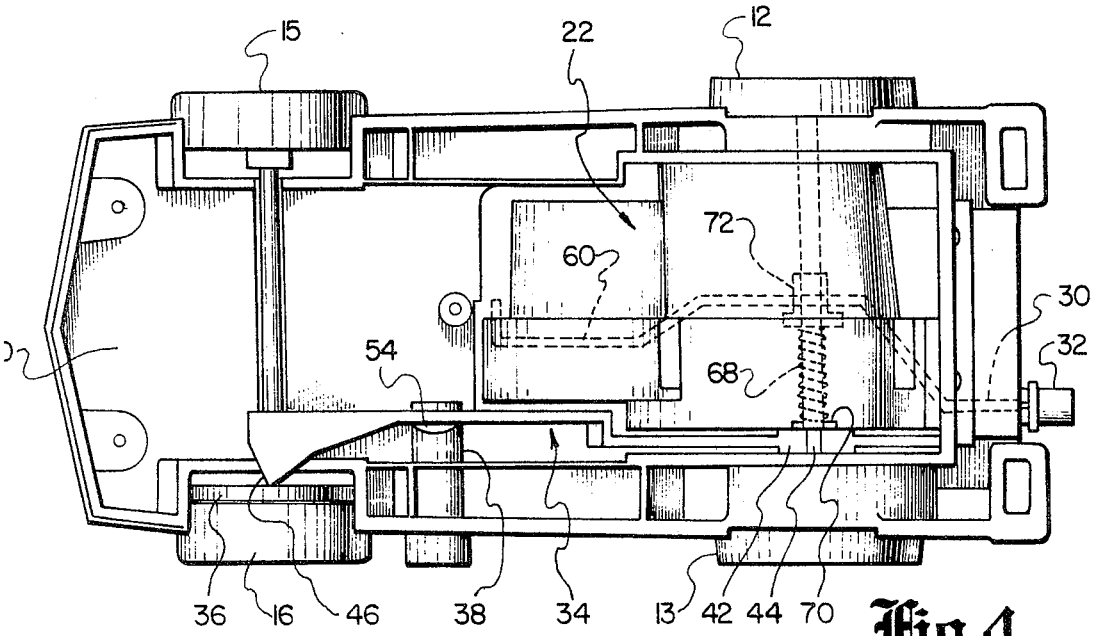
Fig.4.
Fig.5.
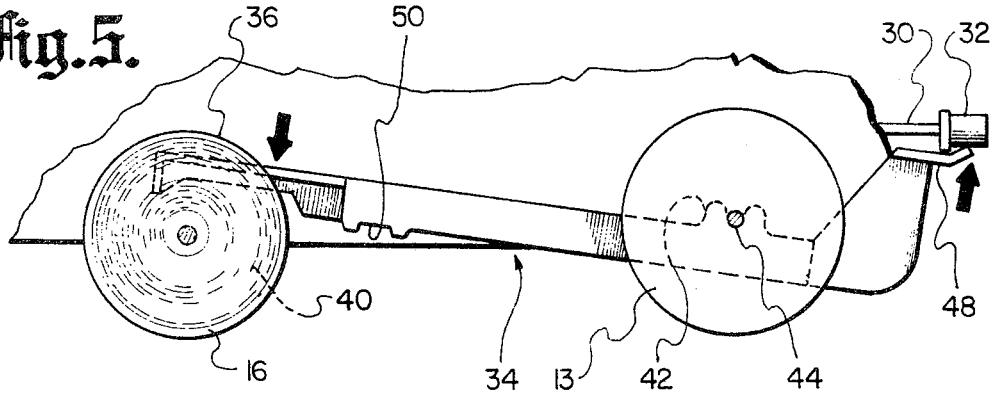
Fig.6.
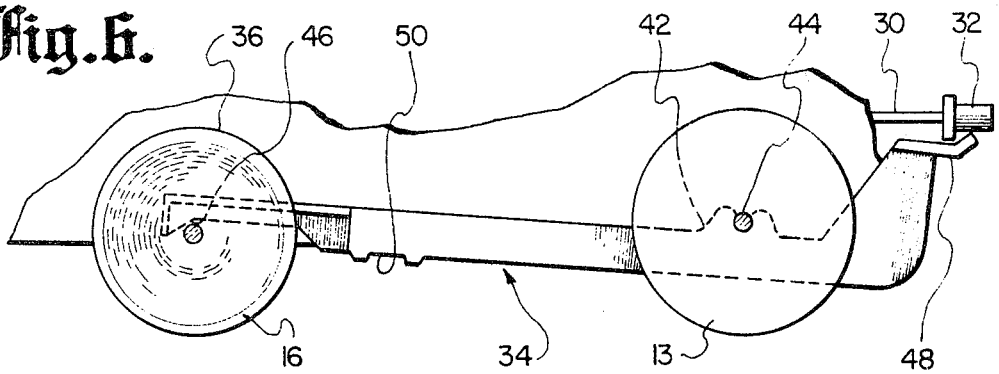

SHIFTING MECHANISM FOR TOY VEHICLE

BACKGROUND OF THE INVENTION

The background of the invention will be discussed in two parts:

1. Field of the Invention

This invention relates to toy vehicles, and more particularly to an automatic shifting mechanism for a toy vehicle having a two-speed motor drive shifted by a control lever.

2. Description of the Prior Art

Toy vehicles have been a constant source of amusement for children, and particularly when the vehicle has different modes of movement. One such toy vehicle is shown and described in U.S. Pat. No. 3,772,824, issued Nov. 20, 1973 to Terzian, et al, the vehicle mechanism being capable of performing "spinning", "rocking" and other motions. In other toy vehicles, two-speed motor mechanisms are provided for enabling the child to preselect a gear ratio, and ultimately control the speed of movement of the vehicle. One elaborate mechanism, which also includes a reverse mode, is shown in U.S. Pat. No. 2,257,064, issued Sept. 23, 1941 to Muller. Another such vehicle is shown and described in U.S. Pat. No. 4,116,084, issued Sept. 26, 1978, to Masuda, the vehicle having a pair of depressible push-buttons extending through the roof thereof, with depressing either button moving a rocking plate about a pivot for changing gears. U.S. Pat. No. 4,059,918, issued Nov. 29, 1977 to Matsushiro illustrates a toy vehicle having a control lever which may be actuated to a "forward" or "reverse" position for selecting the direction of travel of the vehicle.

Other toy vehicles having shiftable drive mechanisms are shown and described in U.S. Pat. Nos. 4,135,328 and 4,141,256, issued Jan. 23, 1979 and Feb. 27, 1979, respectively, to Yamasaki and Wilson, et al, respectively, both these patents being assigned to Mattel, Inc., the assignee of the instant invention.

In the vehicles having speed selection by a control rod or button, the selection is normally made prior to actuating the motor means, or alternatively, after actuation of the motor means, but prior to placing the vehicle on the floor or surface on which it is to be operated. This likewise applies to the toy vehicle mechanisms having direction control levers, such as shown in Matsushiro, although his device makes provision for disengagement of the gears if the vehicle impacts with an obstacle.

Accordingly, it is an object of the present invention to provide a new and improved toy vehicle having an automatic control lever actuating mechanism.

It is another object of the present invention to provide a new and improved shifting mechanism for a toy vehicle for actuating a control device to effect gear changes during movement of the vehicle without operator intervention.

It is still another object of the present invention to provide a new and improved automatic shift mechanism for a toy vehicle having two-speed motor means.

SUMMARY OF THE INVENTION

The foregoing, and other, objects of the invention are accomplished by providing a toy vehicle having a control arm for effecting vehicle movement changes with a pivotable linkage arm having one end adapted to engage cam means for pivoting the linkage arm in response to movement of the toy vehicle a certain distance. The other end of the linkage arm coacts with the control arm to effect movement thereof as the linkage pivots, with movement of the control arm actuating the motor means to a different mode for effecting changes in vehicle movement. In the instant disclosure, the linkage arm has a pointed cam follower engaging a spiral groove on a disc secured to the front wheel of the vehicle, rotation of the wheel moving the cam follower radially. The linkage arm pivots in response to this motion for moving the control arm from a notched position to operate under the force of a spring to an opposite position to change the gear coupling on a two-speed motor drive means.

Other objects, features and advantages of the invention will become apparent from a reading of the specifiction, when taken in conjunction with the drawings, in which, like reference characters refer to like elements in the several views.

BRIEF DESCRIPTION OF THE DRAWINGS

FIG. 1 is a side elevational view of a toy vehicle utilizing the shifting mechanism according to the invention;

FIG. 2 is a rear view of the vehicle of FIG. 1;

FIG. 3 is a bottom plan view of the toy vehicle of FIG. 1;

FIG. 4 is a top plan view of the chassis portion of the vehicle of FIG. 1, the body being removed to illustrate interior details;

FIG. 5 is a diagrammatic side elevational view showing the operative components of the shifting mechanism;

FIG. 6 is a view similar to FIG. 5 showing the operative components in a pivoted position;

DESCRIPTION OF THE PREFERRED EMBODIMENT

Figure 7:
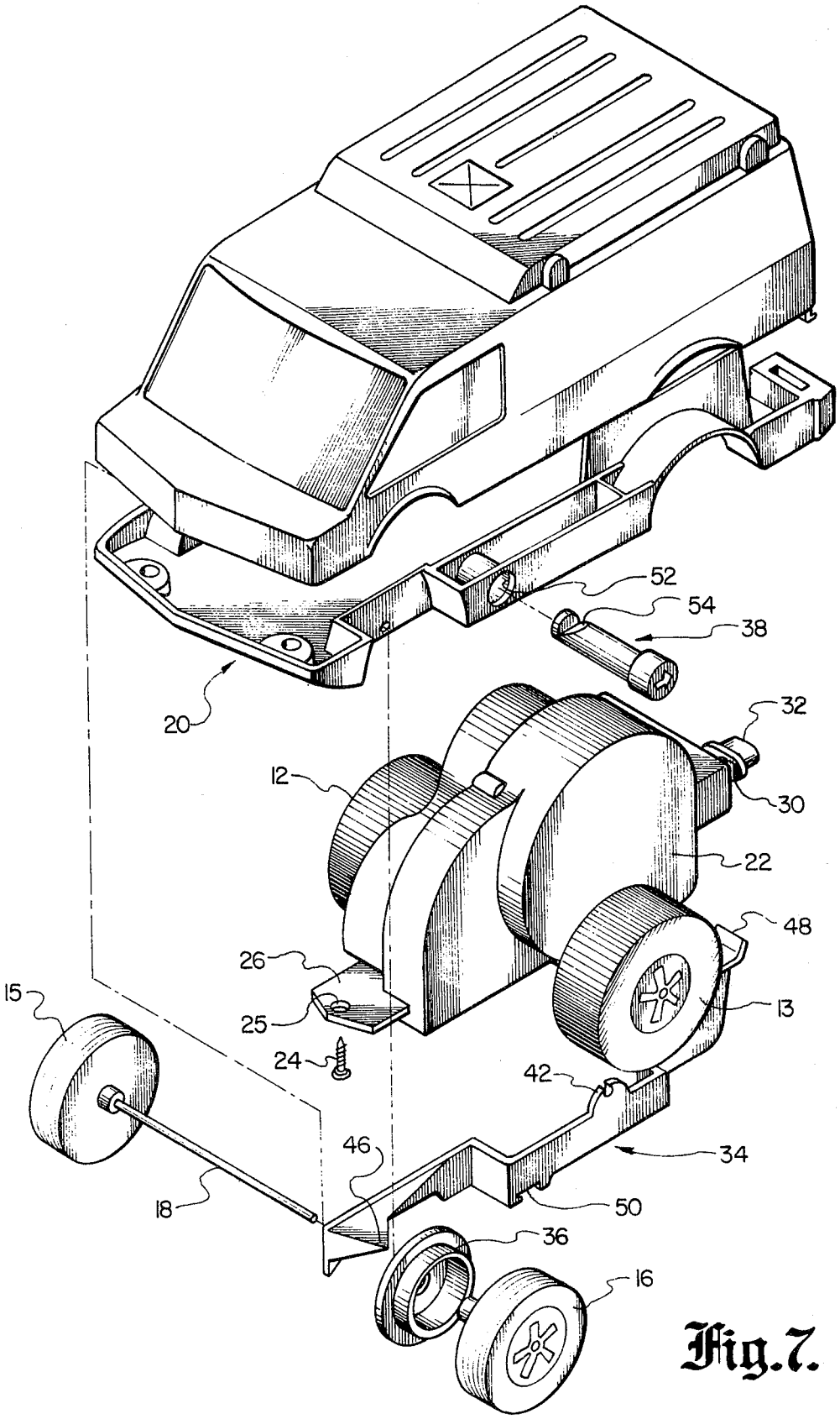
FIG. 7 is an exploded perspective view of the toy vehicle of FIG. 1 illustrating the major parts.

Referring now to the drawings, and particularly to FIGS. 1 through 3 and 7, there is shown a toy vehicle 10, configured in the form of a van-type vehicle, having a pair of rear wheels 12 and 13, and a pair of front wheels 15 and 16. The front wheels 15 and 16 are freely rotatable about an axle 18 secured to the chassis member 20 at the front thereof.

As best illustrated in FIG. 7, the rear wheels 12 and 13 are assembled with, and carried by, a motordrive means module 22 which is suitably secured to the chassis member 20 by fastening means such as screw 24 extending through aperture 25 of a tongue 26 at the forward end of the module 22. Extending from the module 22 at the rear thereof is a control arm 30 having an enlarged cap 32.

The motor drive module 22 is more fully shown and described in U.S. Pat. No. 4,141,256 issued Feb. 27, 1979 to Nicol S. Wilson et al, entitled "Two-Speed Inertia Motor", said patent being herein incorporated by reference as though fully set herein. Although some details of the module 22 will be discussed hereafter with reference to FIGS. 4 and 8, a complete description can be found in the Wilson et al patent. Basically, the motor module is an inertia powered motor having a clutch member operable by a shift fork member by means of the control arm 30 into engagement with a first or second gear arrangement (or neutral) for providing a first or second speed of movement for a vehicle. The shift fork member is urged in a first direction by a compression spring encircling the shaft on which the fork member is slidably mounted. The control arm 30 is suitably bent to engage notches in an elongate slot to fix the position thereof by the operator detenting the arm 30 in the appropriate notch for the desired gear.

It is to be understood, however, that although the description hereafter proceeds with reference to a control arm for shifting the gears in an inertia-powered two-speed motor driven vehicle, the invention has application to other drive means, such as direction reversal by means of a control arm, or movement of an electrical switch control arm where the switch is electrically connected to some means for effecting a change in the movement of the vehicle, or even some part carried by the vehicle.

Referring again to FIGS. 1 through 3 and 7, in addition to the components heretofore described, the vehicle 10 further includes a linkage arm, generally designated 34, a cam means, such as disc 36 and a reset means, such as cam shaft 38. The cam disc 36 is secured to the inner side of the front left wheel 16 and moves concurrently therewith. By reference also to FIGS. 5 and 6, the interior surface of cam disc 36 is provide with a spiral groove 40, much like the groove on a phonograph record.

The linkage arm 34 is provide with an arcuate cutout 42 adjacent the rear end thereof for frictionally pivotably engaging the axle 44 of the motor module 22 (see FIGS. 5 and 6). The forward end of the linkage arm 34 is of a length sufficient to terminate in proximity to the cam disc 36, with the forward portion being suitably bent to clear the front wheel 16. The forward portion of the linkage arm 34 is generally blade shaped and bent, with the free end thereof having a cam follower means 46 in the form of a pyramid extending from the side thereof toward the cam disc 36, the point of the pyramid or cam follower 46 being configured for tracking the spiral groove 40 of the disc 36, similar to a phonograph needle.

Rearwardly of the pivot or cutout 42, the linkage arm 34 extends back and up, terminating in a trigger foot 48, which is of a bent plate-shaped configuration for abuttingly engaging the cap 32 of the control arm 30 of the motor module 22. A downwardly depending cutout 50 is provide on the linkage arm 34 intermediate the pivot or cutout 42 and the cam follower 46 end. By reference particularly to FIGS. 4 and 7, the reset button or cam shaft 38 is inserted through an aperture 52 in the side of chassis member 20, with the lead end having a ramped notch 54 for captively and slidably engaging the depending cutout 50 of the linkage arm 34. The cam shaft 38 is slidable within the aperture 52 with the lower edge of the cutout 50 coacting with the ramp of the ramped notch 54 for presetting the initial amount of pivoting of the linkage arm 34, that is, depression of the shaft 38 raises the front end of the linkage arm 34 to preposition the cam follower 46 relative to the groove 40 of the cam disc 36. The details will be discussed hereafter during description of the operation.

Figure 8:
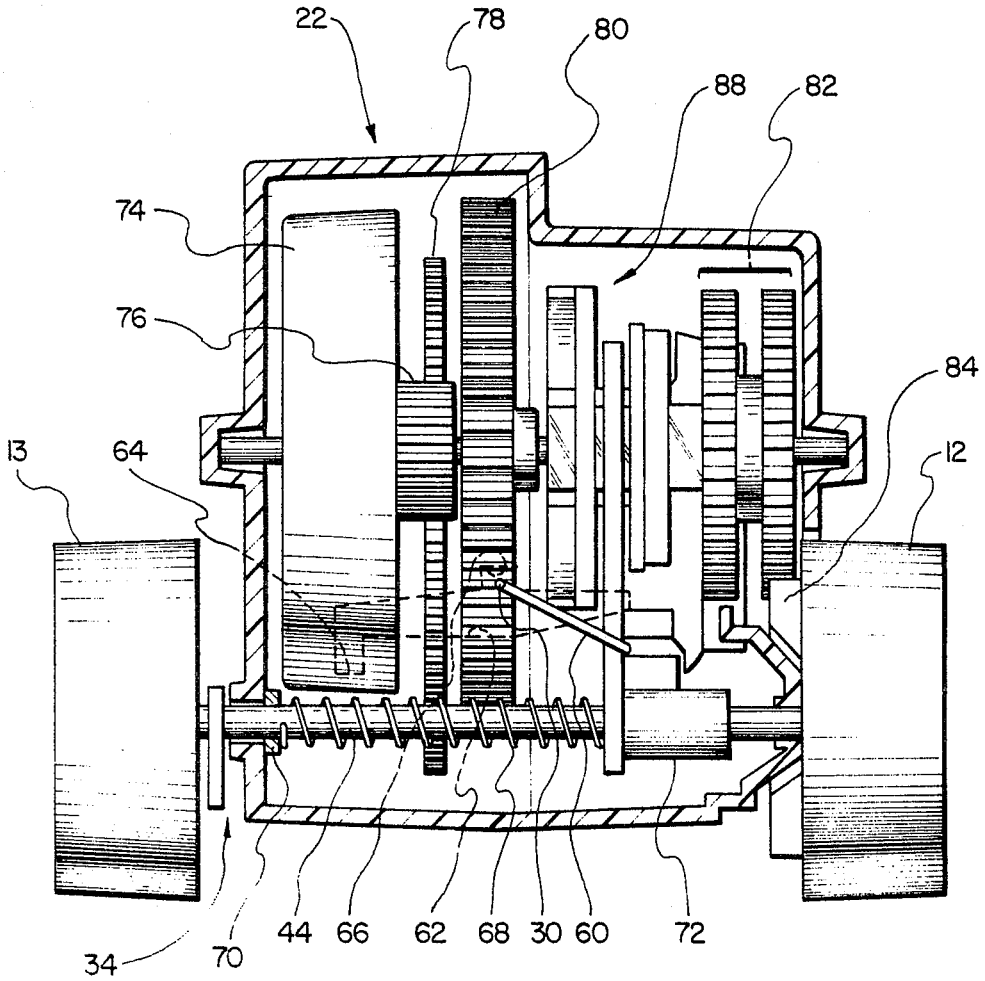
FIG. 8 is a rear end view, partially in cross-section of the motor module of the vehicle of FIG. 1.

Referring now to FIGS. 2, 4 and 8. the control arm 30 is part of an overall shift lever 60 (shown in dotted lines in FIG. 4), the arm 30 traveling within a slot 62 (shown in solid lines in FIG. 2 and dotted lines in FIG. 8). The slot 62 has a downwardly depending notch 64 at the left end thereof, with an upwardly extending notch 66 at the midpoint thereof, the notches 64 and 66 being configured for retaining the control arm 30 in the selected position against the force of a compression spring 68 within the motor module. Referring specifically to FIG. 8, the spring 68 encircles the axle 44 of the motor module 22 between a washer 70 and the shift fork member 72 which is axially slidably mounted on the axle 44. The shift lever 60 is normally urged to the right (as viewed in FIG. 8) under force of the compression spring 68, with the control arm end 30 of the shift lever 60 following within the notched slot 62. As shown in FIG. 8, the control arm 30 is captive within the notch 66 of the slot 62, this position corresponding to the "neutral" position, that is, the position where neither "low" or "high" gear is engaged.

For a complete description of the components of the mechanism of FIG. 8, attention is directed to the aforementioned Wilson et al U.S. Pat. No. 4,141,256, which has been incorporated by reference. However, a brief description of the parts will be herein provided. The motor means 22 includes a flywheel 74 which is rotatable for storing energy, which is transmitted through a gear train including gears 76 and 78, and an intermediate gear assembly (not shown), then selectively through a first gear means, including gear 80, or a second gear means, including gear cluster 82, for ultimately driving drive gear 84 secured for concurrent rotation with drive wheel 12 of the motor module 22. For changing gear ratios, a clutch member 88 is moved to the left, or right (as viewed in FIG. 8) by operation of the shift lever 60 which moves the shift fork member 72, correspondingly to the left or right, to permit selective engagement of the clutch member 88 with the first or second gear means.

A description of the operation of the shifting mechanism will now be described. By reference to FIG. 4, the child holds the vehicle in hand and depresses the "reset" cam shaft 38 inwardly, thereby causing the ramped notch 54 thereof to urge the linkage arm 34 to pivot upwardly, and slightly outwardly. During this movement, by referring to FIG. 5, the arm 34 pivots clockwise while lifting the pointed cam follower end 46 away from the spiral groove 40 while repositioning it radially outwardly from the axle 18. Upon releasing the cam shaft 38, the cam follower end 46 selects the adjacent position of the groove 40 and seats itself. The operator then moves the control arm 30 of the shift lever 60 to the leftmost position (see FIGS. 2, 4 and 8) and detents the control arm 30 within the notch 64 of the slot 62. This position of the control arm 30 corresponds to the selection of "low" gear. In this position, as shown in FIGS. 2 and 5, the cap 32 of the control arm 30 is in proximate, if not abutting, relation with the trigger foot 48. The inertia motor module 22 may then be energized by repeatedly moving the drive wheel 12 over a surface to start rotation of the flywheel 74. During this movement, care must be exercised by the operator to avoid contact of the front wheel 16 carrying the cam disc 36 with the surface, since rotation of this wheel will result in radial displacement of the cam follower end 46 of the linkage arm 34, thus prematurely shifting the mechanism. Alternatively, after initiating movement of the flywheel 74, the operator may then depress the cam shaft 38 to "set" the cam follower end 46 within the groove 40.

In either event, the operator then places the toy vehicle 10 on a surface. With the motor means energized, the vehicle 10 will commence movement. During this movement. the front wheel 16, engaging the surface, will rotate and concurrently therewith, the cam disc 36 will rotate. The configuration of the spiral groove 40 is such that with rotation of the cam disc 36 in the counterclockwise direction, (as viewed in FIG. 7) corresponding to forward movement of the vehicle 10, the pointed cam follower end 46 will track within the groove 40, radially inwardly toward axle 18. By reference to FIGS. 5 and 6, the linkage arm 34 will pivot counterclockwise from the position shown in FIG. 5 to that shown in FIG. 6, at which point the trigger foot 48 is moving upwardly (as illustrated by the arrow in FIG. 5) against cap 32 of control arm 30. During this pivoting the arm 30 will be lifted from the downwardly depending notch 64 of the slot 62 (see FIGS. 2, 4 and 8) and under force of the coil spring 68 the shift lever 60, as well as shift fork member 72 will be moved to the extreme right hand position, with the control arm 30 abutting against the rightmost side of slot 62. This position of control arm 30 corresponds to "high" gear.

As a consequence of this action, the vehicle 10 will commence travel in "low" gear, and after a certain distance (determined by the presetting of the cam follower 46 and the number of turns of the spiral groove 40) will "automatically" shift into "high" gear, and correspondingly, higher speed, thus giving a realistic illusion of real life movement of a vehicle.

The description hereinabove proceeds with reference to a specific configuration of motor means, to wit, a two-speed inertia motor as shown and described in U.S. Pat. No. 4,141,256, which is directed to gear changes only. It is to be understood, however, that the shifting mechanism herein described may also be used with other drive means which change the movement of the vehicle, such as from forward to reverse, by means of a control arm or switch actuated from a first to a second position. For example, the "control arm" may be an electrical switch arm used to switch an electrical motor system from a first speed to a second speed (or from forward to reverse) and the trigger foot herein described may be utilized to perform the movement of the switch, and correspondingly, the vehicle movement, after a certain distance has elapsed based on the "presetting" of the mechanism. Furthermore, additional components may be utilized to effect three-position (or more) movement of the control arm, as opposed to the two-position shifting described.

While there has been shown and described a preferred embodiment, other adaptations and modifications may be made within the spirit and scope of the invention.

I claim:

1. In a toy vehicle, the combination comprising:

a control lever having a control arm portion;

vehicle speed changing drive means responsive to actuation of said control arm portion from a first position to at least one other position;

at least one non-driven wheel member coupled to said vehicle for rotation in response to movement of the vehicle on a surface;

a cam disc member coupled for rotation in response to rotation of said at least one wheel member, said cam disc member having a generally spiral groove in a surface thereof;

a linkage arm member pivotally coupled to said vehicle and having a trigger portion configured for engaging said control arm portion in said first position;

means for biasing said control lever to said at least one other position;

detent means on said vehicle for retaining said control arm portion in said first position against the force of the bias; and a pointed cam follower integrally formed with said linkage arm member and having the point thereof coacting with the groove of said cam disc member for enabling said trigger portion to urge said control arm portion out of engagement with said detent means under force of the bias to said at least one other position during pivoting of said linkage arm member for effecting vehicle speed changing during travel of said vehicle on a surface.

2. The combination according to claim 1 further including reset means engaging said linkage arm member for selectively repositioning the point of said cam follower on the groove of said cam disc member prior to placing said vehicle on a surface for travel.

3. The combination according to claim 1 wherein said drive means includes motor means having clutch means operable in response to movement of said control lever for selectively coupling a first gear means in operative relation between the motor and a drive wheel with said control lever in said first position, and coupling a second gear means between the motor and a drive wheel with said control lever in said at least one other position, whereby to effect a change of speed of the vehicle during travel thereof on a surface.

4. The combination according to claim 3 wherein said combination further includes reset means engaging said linlage arm member for selectively repositioning said pointed cam follower within said generally spiral groove of said cam disc.

5. The combination according to claim 4 wherein said control arm portion has a cap member on the end thereof, and said trigger portion has a plate shaped portion abuttingly engaging said cap member with said control arm portion in said first position.

6. The combination according to claim 5 wherein said control arm portion travels within an elongate slot and said detent means is a downwardly depending notch in one end of said slot.

7. In a toy vehicle, the combination comprising:

motor drive means within said vehicle, said drive means having at least one drive wheel configured for engaging a surface to propel said vehicle with said motor drive means energized;

a control arm means;

means within said drive means responsive to actuation of said control arm means from a first position to at least one other position for changing the speed of movement of said vehicle;

at least one non-driven wheel member coupled to said vehicle for rotation in response to travel of the vehicle on a surface;

a cam disc member coupled for concurrent rotation with said at least one non-driven wheel member, said cam disc member having a generally spiral groove in a surface thereof;

a linkage arm member pivotally coupled within said vehicle and having a pointed cam follower configured and positioned for tracking within said groove to effect pivoting of said linkage arm member in response to rotation of said cam disc member, said linkage arm member having a trigger foot portion adjacent the end thereof opposite said pointed cam follower, said trigger foot portion being positioned for actuating said control arm means from said first position to said at least one other position during pivoting of said linkage arm member for enabling changing the speed of movement of said vehicle during travel thereof; and reset means configured for engaging said linkage arm member for selectively repositioning said pointed cam follower within said generally spiral groove of said cam disc member, said reset means including a depressible shaft member having a notched ramp portion coacting with said linkage arm member for pivoting said linkage arm member in response to depression therof.

8. In a toy vehicle, the combination comprising:

motor drive means including speed changing means within said vehicle, said drive means having at least one drive wheel configured for engaging a surface to propel said vehicle with said motor drive means energized;

a control lever having the end thereof extending through a slotted opening having a notch in one end thereof;

means within said drive means responsive to actuation of said control lever from a first position to at least one other position for changing the speed of movement of said vehicle;

spring means normally biasing said control lever toward said at least one other position, said notch retaining said control lever in said first position against the force of said spring means;

at least one non-driven wheel member coupled to said vehicle for rotation in response to travel of the vehicle on a surface;

a cam disc member coupled for concurrent rotation with said at least one non-driven wheel member, said cam disc member having a generally spiral groove in a surface thereof; and a linkage arm member pivotally coupled within said vehicle and having a pointed cam follower configured and positioned for tracking within said groove to effect pivoting of said linkage arm member in response to rotation of said cam disc member, said linkage arm member having a trigger foot portion adjacent the end thereof opposite said pointed cam follower, said trigger foot portion being positioned for actuating said control lever from said first position to said at least one other position during pivoting of said linkage arm member for enabling actuation of said speed changing means to change the speed of movement of said vehicle during travel thereof.

9. The combination according to claim 8 wherein said notch is downwardly depending and said trigger foot portion pivots in a direction to lift said control lever from said notch.

10. In a toy vehicle, the combination comprising:

at least one non-driven wheel member coupled to said vehicle for rotation in response to movement of the vehicle on a surface;

a control arm;

vehicle speed changing drive means responsive to actuation of said control arm from a first position to at least one other position;

means biasing said control arm to said at least one other position;

detent means for retaining said control arm in said first position against the force of bias of said biasing means;

operating means coupled for actuation in response to rotation of said at least one wheel member;

linkage means configured for engaging said control arm in said first position; and actuator means operatively coupled to said linkage means and coacting with said operating means for actuating said linkage means to urge said control arm out of engagement with said detent means for enabling movement of said control arm under force of the bias to said at least one other position for effecting vehicle speed changing during travel of said vehicle on a surface.

11. The combination according to claim 10 wherein said operating means includes cam means and said actuating means includes cam follower means.

* * * * *